United States Patent [19]

Mistyurik

[11] Patent Number: 4,516,498

[45] Date of Patent: May 14, 1985

[54] HAND-HELD LABELER AND LABELING METHOD

[75] Inventor: John D. Mistyurik, Tipp City, Ohio

[73] Assignee: Monarch Marking Systems, Inc., Dayton, Ohio

[21] Appl. No.: 430,085

[22] Filed: Sep. 30, 1982

Related U.S. Application Data

[60] Division of Ser. No. 416,196, Sep. 9, 1982, , which is a continuation of Ser. No. 243,100, Mar. 12, 1981, abandoned.

[51] Int. Cl.[3] ..... B41K 5/08

[52] U.S. Cl. ..... 101/288; 101/110; 101/426; 400/54; 377/15

[58] Field of Search ..... 400/208, 225, 196, 54; 101/288, 110; 377/15; 235/144 PM, 139 R

[56] References Cited

U.S. PATENT DOCUMENTS

| | | | |
|---|---|---|---|
| 1,283,789 | 11/1918 | Johnson | 377/15 |
| 1,862,446 | 6/1932 | Webb | 377/15 |
| 2,374,927 | 5/1945 | Ford | 400/673 |
| 2,471,617 | 5/1947 | Graham | 400/673 |
| 2,652,772 | 9/1953 | Katz | 101/72 |
| 3,120,800 | 2/1964 | Ward | 101/72 |
| 3,143,963 | 8/1964 | Schrempp | 101/35 |
| 3,330,396 | 7/1967 | James | 400/673 |
| 3,858,508 | 1/1975 | Kaneko et al. | 101/142 |
| 3,933,092 | 1/1976 | Kirby | 101/288 |
| 4,091,414 | 5/1978 | Stipanuk | 400/196.1 |
| 4,091,913 | 5/1978 | Ku et al. | 400/225 |
| 4,116,747 | 9/1978 | Hamisch, Jr. | 101/288 |
| 4,200,390 | 4/1980 | Tagashira et al. | 101/142 |
| 4,207,132 | 6/1980 | Hamisch, Jr. | 156/384 |
| 4,246,643 | 1/1981 | Hubbard | 101/91 |
| 4,290,355 | 9/1981 | Gross et al. | 101/69 |
| 4,350,554 | 9/1982 | Pabodie | 101/288 |
| 4,359,939 | 11/1982 | Sato | 101/288 |
| 4,364,312 | 12/1982 | Sato | 101/110 |

FOREIGN PATENT DOCUMENTS

| | | | |
|---|---|---|---|
| 492417 | 11/1975 | Australia | 101/142 |
| 40312 | 11/1981 | European Pat. Off. | 400/54 |
| 575630 | 4/1933 | Fed. Rep. of Germany | 400/673 |
| 56-3661 | 1/1981 | Japan | 101/288 |

*Primary Examiner*—William Pieprz

*Attorney, Agent, or Firm*—Joseph J. Grass

[57] ABSTRACT

There is disclosed a manually operable, hand-held labeler with a resettable counter which prevents operation of the labeler beyond a predetermined number of cycles, and there is disclosed a method of labeling using a hand-held labeler which involves preventing operation of the labeler beyond a predetermined number of cycles.

16 Claims, 8 Drawing Figures

HAND-HELD LABELER AND LABELING METHOD

CROSS-REFERENCE TO RELATED APPLICATIONS

This application is a division of Ser. No. 416,196, filed Sept. 9, 1982 which is a continuation of Ser. No. 243,100, filed Mar. 12, 1981, now abandoned, and all are assigned to the same assignee.

BACKGROUND OF THE INVENTION

1. Field of the Invention

This invention relates to the art of hand-held labelers and to labeling method using hand-held labelers.

2. Brief Description of the Prior Art

It is known in the United States to provide table top, electrically driven imprinters such as disclosed in U.S. Pat. No. 3,933,092 granted Jan. 20, 1976 to Raymond L. Kirby, Jr. with a counter that results in prevention of operation of the imprinter upon completion of a predetermined number of cycles of operation to indicate that the inking member should be changed. U.S. Pat. No. 3,143,963 discloses a printer which is disabled after a predetermined number of inking cycles of an ink supply unit and enabling the printer again only after the ink supply unit is replaced by a new unit.

SUMMARY OF THE INVENTION

This invention relates to a simple, compact, low-cost hand-held labeler which includes a mechanism especially well suited for a hand-held labeler to prevent operation of the labeler when the labeler has undergone a predetermined number of cycles. When operation of the labeler is prevented, the operator knows that the inking member is spent and must be replaced with a new inking member. This feature is especially important when the hand-held labeler is required to print codes such as bar codes, the OCR code and other indicia requiring high-quality printing. Various considerations are important in devising a suitable mechanism for preventing operation of a hand-held labeler beyond a predetermined number of cycles. The mechanism must be compact so as to fit in restricted available spaces in a marketplace-acceptable labeler. The mechanism should be lightweight so as to add only minimum weight. The mechanism should require only a small amount of energy to operate. The construction of the mechanism should be simple, should have few parts and should be easy to assemble and reliable in operation. In addition the mechanism should be resettable so that the labeler can continue to be used after the inking member has been replaced and the mechanism has been reset.

In accordance with a specific embodiment of the invention there is provided a hand-held labeler for printing and applying labels releasably secured to a carrier web. The labeler has a housing with a handle. A manually operable actuator is disposed at the handle so that the actuator can be readily manually operated. A print head is movable in response to movement of the actuator into and out of printing cooperation with the platen. An inking member is used to ink the print head. Printed labels are peeled or delaminated from the carrier web by a delaminator upon advance of the carrier web by a driver or drive member. Labels dispensed at the delaminator are disposed in label applying relationship with respect to a label applicator. The labeler includes a mechanism which is especially well suited to prevent operation or cycling of a hand-held labeler beyond a predetermined number of cycles. When the labeler has undergone the predetermined number of cycles, the mechanism prevents full travel of actuator between the initial or rest position and the actuated position, and more specifically the mechanism prevents complete return of the actuator to its initial position. The illustrated drive arrangement for the labeler is a pawl and ratchet drive mechanism which is responsive to the operation of the actuator. The pawl and ratchet drive mechanism includes a pawl and ratchet driven by the pawl. By preventing return of the actuator to its initial position the pawl is unable to drive the ratchet and advance the driver and consequently the carrier web cannot be advanced. The mechanism which prevents operation of the labeler beyond a predetermined number of cycles is resettable and is operable by a reliable pawl and ratchet mechanism. The operation preventing mechanism includes a counter which locks up when a predetermined count is reached, and yet the counter has means for enabling the counter to be manually reset. The energy required to operate the counter and the pawl and ratchet mechanism which drives it is low, and because, as is preferred the parts are mainly of plastics material the inertia is miniscule. In the illustrated embodiment, the counter includes a pinion gear or sun gear and a plurality of satellite gears in mesh with the pinion gear. The satellite gears are shown to have different numbers of teeth. The pinion gear is held in one axial position by webs or flanges disposed at the ends of teeth of the satellite gears. Each flange has at least one opening. It is only when all the openings are simultaneously aligned with the pinion gear that a spring can shift the pinion gear into the path of the flange of each gear to lock up the counter. Resetting of the counter is accomplished by shifting the pinion gear to its initial operating position and advancing the pinion gear slightly to bring the pinion gear out of simultaneous alignment with the openings. The labeler of the invention accomplishes all the above sought-after advantages. The invention also relates to method of labeling which preferably includes counting the number of actuations of the actuator and blocking the further advance of the carrier web when the count reaches a predetermined number, thereafter replacing the inking member with a new inking member, and unblocking the advance of the carrier web until the count has again reached a predetermined number.

DESCRIPTION OF THE PREFERRED EMBODIMENT

Figure 1:
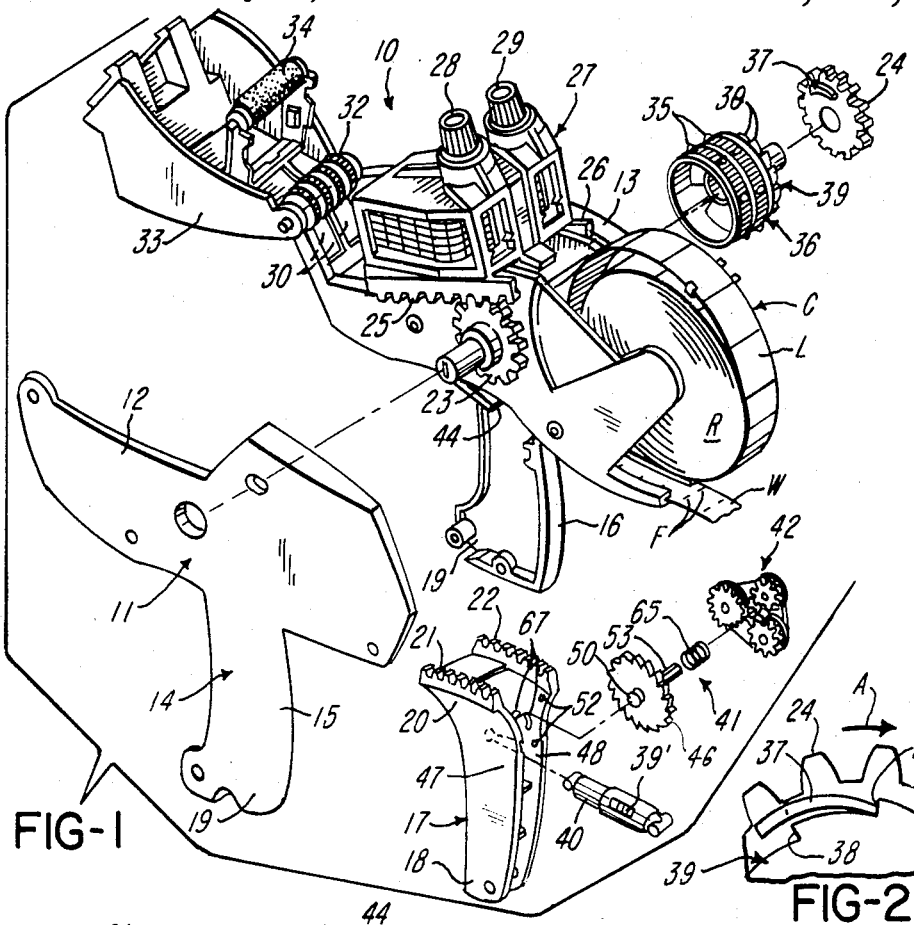
FIG. 1 is a partly exploded perspective view of a labeler with a mechanism for preventing operation of the labeler beyond a predetermined number of cycles.
Figure 2:
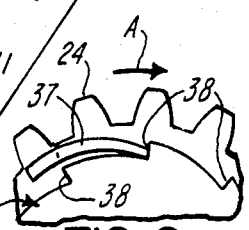
FIG. 2 is a fragmentary perspective view of the pawl and ratchet drive mechanism of the labeler.
Figure 4:
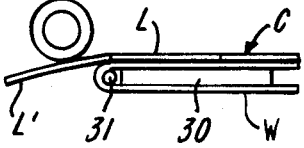
FIG. 4 is a diagrammatic elevational view showing how a label is dispensed into label applying relationship with respect to a label applicator.

With reference to FIG. 1, there is shown a labeler generally indicated at 10 shown in greater detail in U.S. Pat. No. 4,116,747 granted Sept. 26, 1978 to Paul H. Hamisch, Jr., the disclosure of which is incorporated herein by reference. Briefly, the labeler 10 includes a housing or frame 11 comprised of housing sections 12 and 13. Although the labeler 10 is disclosed as having a housing or a frame 11, the invention is not dependent upon any particular arrangement or construction of a frame or housing for supporting operative components of the labeler 10, so long as the labeler 10 is of a portable, hand-held type. The housing 11 includes a handle 14 shown to be comprised of handle portions 15 and 16 of the respective housing sections 12 and 13. An actuator 17 is pivotally mounted at its one end portion 18 to outer end portion 19 of the handle 14. The other end portion 20 of the actuator 17 is shown to include a pair of gear sections or segmental gears 21 and 22. The gear sections 21 and 22 mesh with respective gears 23 and 24 which in turn mesh with respective racks or gears 25 and 26 of the print head 27. The print head 27 is shown to be capable of printing two lines of data, each line being selectively settable by a respective knob 28 and 29. The print head 27 is mounted for straight line reciprocating movement into and out of printing cooperation with a platen 30. As best shown in FIG. 4, a delaminator 31 is shown to be adjacent the platen and an applicator 32 is shown to be adjacent the delaminator 31. In FIG. 1, a cover section 33 of the housing 11 is shown in the open position to expose an inking member 34 which in its normal operating position inks the print head 27 during each cycle of labeler operation. The labeler 10 is shown to mount a roll R of a composite label web C. The composite web C has labels L releasably secured to a carrier web W. The carrier web W has regularly spaced feed cuts F which are engaged by teeth 35 of a toothed driver 36. The driver 36 specifically takes the form of a feed wheel. The gear 24 is illustrated as mounting a resilient pawl 37 which is cooperable with successive teeth 38 of a ratchet wheel 39. As best shown in FIG. 2, the pawl 37 is engaged with a tooth 38 and drives the ratchet wheel 39 in the direction of the arrow A when the gear 24 moves in the direction of the arrow A. When the gear moves opposite to the direction of the arrow A, the pawl engages the next adjacent tooth 38 and thereafter when the gear 24 again moves in the direction of the arrow A the pawl 37 drives the ratchet wheel 39. The movement which the ratchet wheel 39 imparts to the toothed driver 36 advances the carrier web W to move the label L which is on the platen 30 into the position shown for the leading label L' in label applying relationship relative to the applicator 32. More specifically, when the actuator 17 is operated the gearing which comprises gear sections 21 and 22, gears 23 and 24, and racks 25 and 26 moves the print head 27 into printing cooperation with the platen 30 and because the gear 24 moves in a direction opposite to the direction of arrow A, the pawl 37 moves from engagement with one tooth into engagement with the next adjacent tooth. Upon release of the actuator 17, a spring 39' of a telescoping spring device 40 urges the actuator 17 in a direction opposite to the direction of arrow B and thus the pawl 37 is driven in the direction of arrow A to advance the ratchet wheel 39 and the driver 36 to the carrier web W by a distance equal to the length or pitch of one label L.

Figure 3:
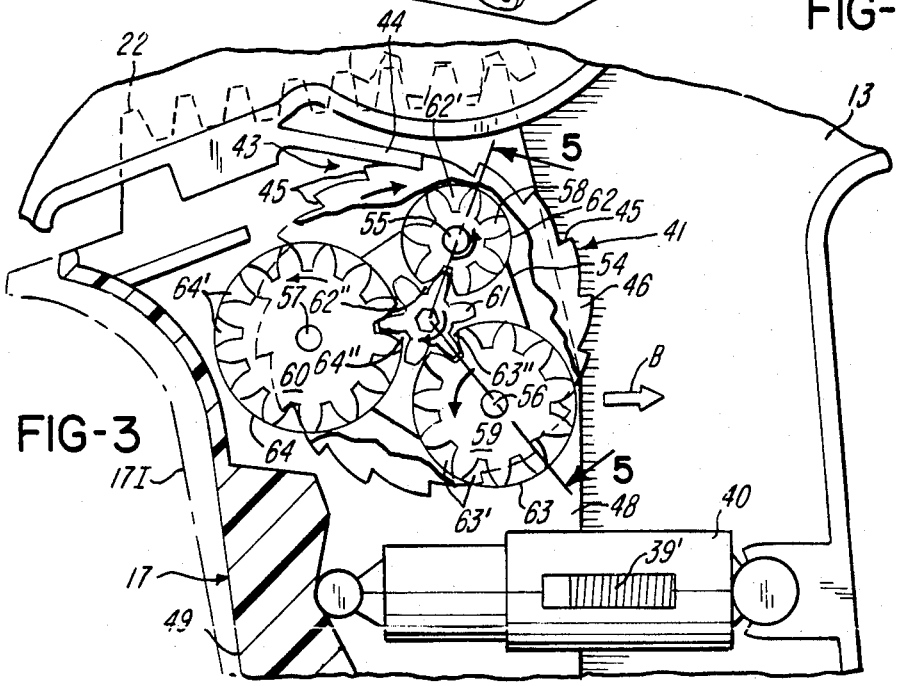
FIG. 3 is a partly broken away fragmentary elevational view of the labeler showing the pawl and ratchet mechanism which advances the counter, the counter being shown in the locked-up position.
Figure 5:
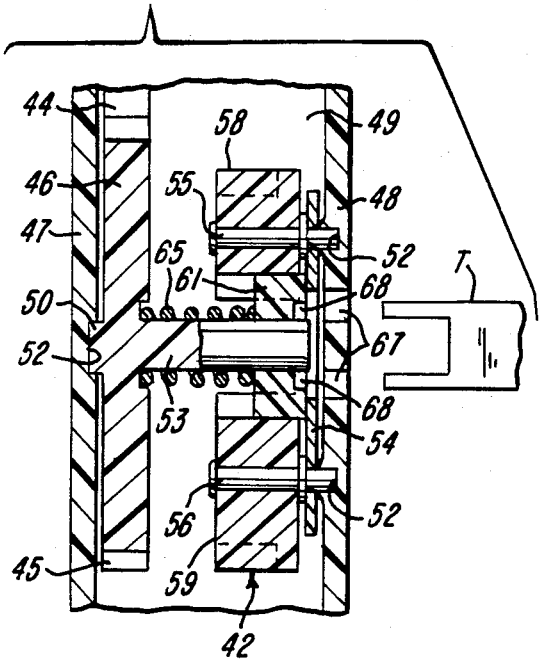
FIG. 5 is a sectional view taken generally along line 5—5 of FIG. 3.
Figure 7:
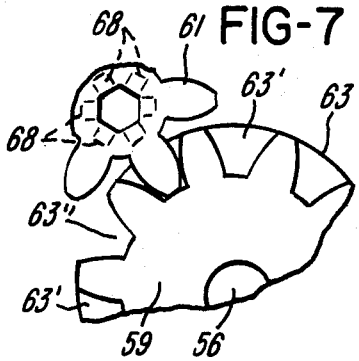
FIG. 7 is an enlarged fragmentary view of a pinion gear and a meshing satellite gear in the operating position.
Figure 6:
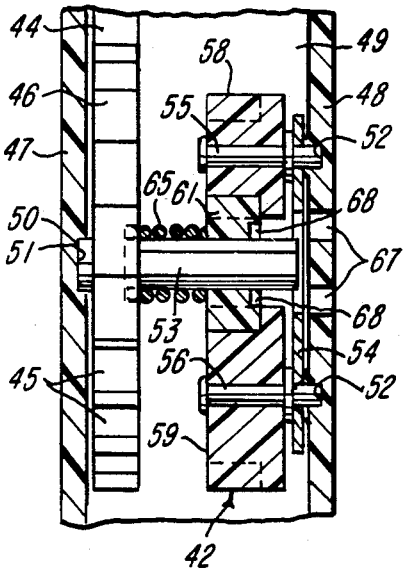
FIG. 6 is a sectional view similar to FIG. 5 but showing the counter in an operating position.
Figure 8:
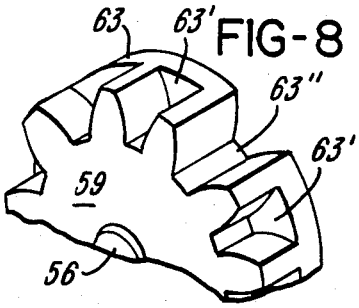
FIG. 8 is a fragmentary perspective view of the satellite gear shown in FIG. 7, for example.

In order to prevent operation of the labeler 10 beyond a predetermined number of cycles of operation, there is provided a mechanism generally indicated at 41 which includes a resettable counter 42 and a pawl and ratchet mechanism 43 for operating the counter 42. The pawl and ratchet mechanism 43 is shown to include a resilient pawl 44 cooperable with teeth 45 of a ratchet wheel 46. The pawl 44 is suitably mounted by the housing 11, and the ratchet wheel 46 and the counter 42 are illustrated as being disposed in and carried by the actuator 17. The actuator 17 is shown to be U-shaped in section and to have spaced generally parallel walls 47 and 48 joined by a rounded, finger-engageable bight portion 49. A shown in FIGS. 1, 5 and 6, the ratchet wheel 46 has an annular stub shaft 50 which is insertable into an annular hole 51 in the wall 47. The wall 48 has three spaced holes 52. The stub shaft 50 and a non-circular, specifically hex-shaped shaft 53 are disposed axially of the ratchet wheel 46. A plate 54 which can be metal and has a plurality of pins 55, 56 and 57. The pins 55, 56 and 57 rotatably mount respective satellite gears 58, 59 and 60 and the pins 55, 56 and 57 project into the holes 52. To insert the ratchet wheel 46 and counter 42 into the space between the walls 47 and 48, the spring 65 is compressed slightly more than shown in FIG. 6 and the stub shaft 50 is aligned with the hole 51 and pins 55, 56 and 57 are aligned with respective holes 52. The spring 65 will then urge the ratchet wheel 46 and the plate 54 apart to move stub shaft 50 into hole 51 and to move pins 55, 56 and 57 into respective holes 52. The gears 58, 59 and 60 are in mesh with a pinion or sun gear 61 which is slidably mounted on the shaft 53. Each gear 58, 59 and 60 has an end wall or flange 62, 63 or 64 respectively. The end walls 61, 62 and 63 have a plurality of webs 61', 62' and 63' which prevent a spring 65 received on the shaft 53 from shifting the pinion gear 61 to the right as viewed in FIG. 6. Each gear 58, 59 and 60 has at least one opening 62", 63" and 64". The gears 58, 59, 60 and 61 have differing numbers of teeth. By way of example, not limitation, the gear 61 has an even number, specifically six teeth, the gear 58 has an odd number specifically seven teeth, the gear 59 has eleven teeth and the gear 60 has thirteen teeth. As the counter 42 advances there are times when one or more but less than all the openings 62", 63" and 64" become aligned with a corresponding tooth of the pinion gear 61, and during all such times at least one of the webs 62', 63' or 64' holds the pinion gear 61 in the operating or normal position shown in FIG. 6. However, when the counter 42 has advanced to such a position or count at which all the openings 62", 63" and 64" are aligned with corresponding teeth of the pinion gear 61, the spring 65 will slide the pinion gear 61 to the right from the position as viewed in FIG. 6 to the position as viewed in FIG. 5. In the position of FIG. 5, the gear 61 is in the path of the webs 62', 63' and 64' of the respective gears 58, 59 and 60 and therefore the gear 61 cannot rotate. The arrows on the gears 58 through 61 and on the ratchet wheel 46 in FIG. 3 indicate their normal rotational directions, but in FIG. 3 the openings 62", 63" and 64" are aligned with the teeth of gear 61 and the gear 61 is in the position of FIG. 5 and thus none of the gears 58 through 61 or the ratchet wheel 46 can rotate. Thus, the entire counter 42 is locked against operation. The non-circular shaft 53 operating in the non-circular hole 61' in the gear 61, prevents rotation between the gear 61 and the ratchet wheel 46. Thus, when the gear 61 is locked against rotation (FIG. 5), the ratchet wheel 46 is likewise unable to rotate. Accordingly, when the spring 39 attempts to return the actuator 17 to its initial position indicated by phantom line 17I, a tooth 45 of the ratchet wheel 46 comes into contact with the pawl 44 to prevent return of the actuator 17 to its initial position 17I. Because the actuator 17 does not return to its initial position 17I, the gear 24 does not move the pawl 37 in the direction opposite to the direction of arrow A far enough to come into engagement with the next adjacent tooth, and consequently when the actuator 17 is operated again, the pawl 44 cannot advance the ratchet wheel 39 and in turn the toothed driver 36 is not advanced. Accordingly, the drive for the carrier web W is disabled and the labeler 10 is no longer able to print and apply labels L. This is notwithstanding the fact that the print head 27 is able to move into and out of printing cooperation with the platen 30. The operator of the labeler 10 is thus notified that the inking member 34 must be replaced with a new inking member 34 having a fresh supply of ink. The labeler can be restored to normal cycling operation by inserting a tool T through arcuate slots 67 in the wall 48 and into two opposite recesses 68 in the gear 61, exerting an axial force against the gear 61 and compressing the spring 65 sufficiently to bring the gear 61 out of the path of end walls 61', 63' and 64', and thereafter rotating the gear 61 slightly to advance the counter 42. The counter 42 is not reset and the labeler 10 can now again operate for the predetermined number of cycles, after which the counter 42 will again lock up to prevent cycling of the labeler 10.

To increase the number of cycles of operation of the counter 42 before lock-up, the number of teeth on one or all the gears 58, 59 and 60 can be increased. Alternatively the size of the gear 61 can be increased and an additional satellite gear can be added, or the size of the ratchet wheel 46 can be increased. To decrease the number of cycles, one of the gears 58, 59 or 60 can have two openings, or one of the satellite gears 58, 59 or 60 can be eliminated, or the size of the ratchet wheel 46 can be reduced. However, it will be understood that change in the size of the ratchet wheel 46 will require change in location of the ratchet wheel or relocation of the pawl 44.

Although reference is made herein to an inking member and an ink roller 34 is illustrated, the invention is not limited to any particular type of inking member, for example an ink pad or ink ribbon can be used as the inking member or an ink cartridge can be used in conjunction with an ink roller or pad, by way of example.

Other embodiments and modifications of this invention will suggest themselves to those skilled in the art, and all such of these as come within the spirit of this invention are included within its scope as best defined by the appended claims.

I claim:

1. A hand-held labeler for printing and applying labels releasably secured to a carrier web, comprising: a housing having a handle, a manually operable actuator disposed at the handle and movable from an initial position, to an actuated position, and again to its initial position, a platen, a print head cooperable with the platen, an inking member for inking the print head, means for delaminating printed labels, means for applying printed labels, a drive member engageable with the carrier web for advancing the carrier web, means coupled to the actuator for moving the print head and for moving the drive member through a cycle of operation to print and dispense labels one at a time into label applying relationship with respect to the label applying means, and means for blocking return of the actuator to prevent operation of the moving means.

2. A hand-held labeler as defined in claim 1 wherein the blocking means includes a resettable counter.

3. A hand-held labeler for printing and applying labels releasably secured to a carrier web, comprising: a housing having a handle, a manually operable actuator disposed at the handle and movable from an initial position, to an actuated position, and to its initial position, a platen, a print head cooperable with the platen, an inking member for inking the print head, means for delaminating printed labels, means for applying printed labels, a drive member engageable with the carrier web and movable in response to movement of the actuator from its initial position to its actuated position and return to its initial position for advancing the carrier web to advance one label at a time into label applying relationship relative to the label applying means, and means responsive to a predetermined number of actuations of the actuator for blocking return of the actuator to its initial position.

4. A hand-held labeler for printing and applying labels releasably secured to a carrier web, comprising: a housing having a handle, a manually operable actuator disposed at the handle and movable from an initial position, to an actuated position, and to its initial position, a platen, a print head cooperable with the platen, an inking member for inking the print head, means for delaminating printed labels, means for applying printed labels, a drive member engageable with the carrier web and movable in response to movement of the actuator from its initial position to its actuated position and return to its initial position for advancing the carrier web to advance one label at a time into label applying relationship relative to the label applying means, a pawl and ratchet mechanism coupled to the drive member, and means responsive to a predetermined number of actuations of the actuator for blocking return of the actuator to its initial position to in turn prevent operation of the pawl and ratchet mechanism.

5. A hand-held labeler for printing and applying labels releasably secured to a carrier web, comprising: a housing having a handle, a manually operable actuator disposed at the handle and movable from an initial position, to an actuated position, and to its initial position, a platen, a print head cooperable with the platen, an inking member for inking the print head, means for delaminating printed labels, means for applying printed labels, a drive member engageable with the carrier web and movable in response to movement of the actuator from its initial position to its actuated position and return to its initial position for advancing the carrier web to advance one label at a time into label applying relationship relative to the label applying means, a pawl and ratchet mechanism coupled to the drive member, and means responsive to a predetermined number of actuations of the actuator for blocking return of the actuator to its initial position to in turn prevent operation of the pawl and ratchet mechanism, wherein the blocking means includes a resettable counter.

6. A hand-held labeler for printing and applying labels releasably secured to a carrier web, comprising: a housing having a handle, a manually operable actuator having a pair of spaced walls disposed at the handle, a platen, a print head cooperable with the platen, gearing coupling the actuator and the print head, an inking member for inking the print head, means for delaminating printed labels, means for applying printed labels, a toothed feed wheel, a first pawl and ratchet mechanism coupled to the gearing for advancing the toothed feed wheel to advance the carrier web, the first pawl and ratchet mechanism including a first pawl coupled to the gearing and a first ratchet wheel coupled to the feed wheel, means pivotally mounting the actuator at an outer end portion of the handle, a second pawl and ratchet mechanism including a second ratchet wheel movably mounted between the spaced walls of the actuator, a second pawl mounted on the housing and cooperable with the second ratchet wheel along its axis, a pinion gear slidably mounted on the shaft and having a non-circular mating hole for receiving the shaft, a plurality of satellite gears in mesh with the pinion gear, a plate having a plurality of shafts for rotatably mounting the satellite gears, each satellite gear having an end wall and at least one opening in the end wall between two adjacent teeth of each gear, the pinion gear being shiftable so that teeth of the pinion gear project into the openings when an opening of each gear is aligned with a tooth of the pinion, and a spring received about the non-circular shaft for urging the pinion gear against the end walls and for urging the pinion gear into the openings when all the openings are aligned with teeth of the pinion.

7. A hand-held labeler as defined in claim 6, wherein the pinion gear has six teeth, there being first, second and third satellite gears, wherein the first satellite gear has seven teeth, the second satellite gear has eleven teeth, and the third satellite gear has thirteen teeth, and wherein the second ratchet wheel has eighteen teeth.

8. A hand-held labeler as defined in claim 6, wherein the second ratchet wheel, the pinion gear and the satellite gears are composed of molded plastics material.

9. A hand-held labeler for printing and applying labels releasably secured to a carrier web, comprising: a housing having a handle, a manually operable actuator disposed at the handle, a platen, a print head cooperable with the platen, an inking member for inking the print head, means for delaminating printed labels, means for applying printed labels, a drive member engageable with the carrier web for advancing the carrier web, means coupled to the actuator for moving the print head and the drive member through a cycle of operation to print and dispense labels one at a time into label applying relationship with respect to the label applying means, means responsive to operation of the actuator through a predetermined number of cycles for preventing operation through a further cycle, wherein the operation preventing means includes a resettable locking counter and a pawl and ratchet mechanism for advancing the counter, the pawl and ratchet mechanism including a ratchet wheel and a pawl for operating the ratchet wheel, the pawl being mounted to the housing, the counter being mounted on the actuator, and means coupling the ratchet wheel and the counter, wherein the counter includes a pinion gear and a plurality of satellite gears in mesh with the pinion gear, wherein the pinion gear is slidably mounted relatively to the satellite gears, wherein each satellite gear has a plurality of teeth and means adjacent less than all of the teeth for preventing axial shifting of the pinion gear except when all the satellite gears are in a predetermined relationship with respect to each other, and spring means for shifting the pinion gear axially to a locking position.

10. A hand-held labeler for printing and applying labels releasably secured to a carrier web, comprising: a housing having a handle, a manually operable actuator disposed at the handle, a platen, a print head cooperable with the platen, an inking member for inking the print head, means for delaminating printed labels, means for applying printed labels, a drive means engageable with the carrier web for advancing the carrier web, means coupled to the actuator for moving the print head and the drive member through a cycle of operation to print and dispense labels one at a time into label applying relationship with respect to the label applying means, means responsive to operation of the actuator through a predetermined number of cycles for preventing operation through a further cycle, wherein the operation preventing means includes a counter having a pinion gear and a plurality of satellite gears in mesh with the pinion gear, wherein the pinion gear is slidably mounted relatively to the satellite gears, wherein each satellite gear has a plurality of teeth and means adjacent less than all of the teeth for preventing axial shifting of the pinion gear except when all the satellite gears are in a predetermined relationship with respect to each other, and spring means for shifting the pinion gear axially to a locking position.

11. A hand-held labeler for printing and applying labels releasably secured to a carrier web, comprising: a housing having a handle, a manually operable actuator disposed at the handle, a platen, a print head cooperable with the platen, an inking member for inking the print head, means for delaminating printed labels, means for applying printed labels, a drive member engageable with the carrier web for advancing the carrier web, means coupled to the actuator for moving the print head and the drive member through a cycle of operation to print and dispense labels one at a time into label applying relationship with respect to the label applying means, means responsive to operation of the actuator through a predetermined number of cycles for preventing operation through a further cycle, wherein the moving means includes a pawl and ratchet mechanism, wherein the actuator is movable between an initial position and an actuated position, wherein the actuator must move from the initial position to the actuated position and return to the initial position in order for the actuator to effect operation of the pawl and ratchet mechanism, and wherein the operation preventing means includes means for blocking return of the actuator to its initial position.

12. A hand-held labeler for printing and applying labels releasably secured to a carrier web, comprising: a housing having a handle, a manually operable actuator disposed at the handle, a platen, a print head cooperable with the platen, an inking member for inking the print head, means for delaminating printed labels, means for applying printed labels, a drive member engageable with the carrier web for advancing the carrier web, means coupled to the actuator for moving the print head and the drive member through a cycle of operation to print and dispense labels one at a time into label applying relationship with respect to the label applying means, means responsive to operation of the actuator through a predetermined number of cycles and including a pawl and ratchet mechanism for preventing operation through a further cycle, wherein the moving means includes a pawl and ratchet mechanism, wherein the actuator is movable between an initial position and an actuated position, wherein the actuator must move from the initial position to the actuated position and return to the initial position in order for the actuator to effect operation of the pawl and ratchet mechanism, and wherein the operation preventing means includes means for blocking return of the actuator to its initial position.

13. A hand-held labeler for printing and applying labels releasably secured to a carrier web, comprising: a housing having a handle, a manually operable actuator disposed at the handle, a platen, a print head cooperable with the platen, an inking member for inking the print head, means for delaminating printed labels, means for applying printed labels, a drive member engageable with the carrier web for advancing the carrier web, means coupled to the actuator for moving the print head and the drive member through a cycle of operation to print and dispense labels one at a time into label applying relationship with respect to the label applying means, means responsive to operation of the actuator through a predetermined number of cycles and including a counter for preventing operation through a further cycle, wherein the moving means includes a pawl and ratchet mechanism, wherein the actuator is movable between an initial position and an actuated position, wherein the actuator must move from the initial position to the actuated position and return to the initial position in order for the actuator to effect operation of the pawl and ratchet mechanism, and wherein the operation preventing means includes means for blocking return of the actuator to its initial position.

14. A hand-held labeler for printing and applying labels releasably secured to a carrier web, comprising: a housing having a handle, a manually operable actuator disposed at the handle, a platen, a print head cooperable with the platen, a replaceable inking member for inking the print head, means for delaminating printed labels, means for applying printed labels, a drive member engageable with the carrier web for advancing the carrier web, means coupled to the actuator for moving the print head and the drive member through a cycle of operation to print and dispense labels one at a time into label applying relationship with respect to the label applying means, means reponsive to operation of the actuator through a predetermined number of cycles and including a resettable counter for preventing operation through a further cycle, means for resetting the counter, wherein the moving means includes a pawl and ratchet mechanism, wherein the actuator is movable between an initial position and an actuated position, wherein the actuator must move from the initial position to the actuated position and return to the initial position in order for the actuator to effect operation of the pawl and ratchet mechanism, and wherein the operation preventing means includes means for blocking return to the actuator to its initial position.

15. Method of labeling, comprising the steps: providing a hand-held labeler operable by a manually operable actuator through successive cycles, in which during each cycle a print head prints on a label when the actuator is moved from its initial position to its actuated position and the printed label is dispensed into label applying relationship with respect to a label applicator when the actuator returns to its initial position, the print head being inked during each cycle, wherein the labels are disposed on a carrier web and are dispensed at a delaminator when the carrier web is advanced by a driver, using a pawl and ratchet mechanism to advance the driver, blocking the return of the actuator to its initial position when the actuator has been operated a predetermined number of times to prevent operation of the pawl and ratchet mechanism, replacing the inking member, and unblocking the return of the actuator to enable operation of the pawl and ratchet mechanism until the labeler has again been operated the predetermined number of times.

16. Method of labeling, comprising the steps of: providing a hand-held labeler operable by a manually operable actuator through successive cycles, in which during each cycle a print head prints on a label when the actuator is moved from its initial position to its actuated position and the printed label is dispensed into label applying relationship with respect to a label applicator when the actuator returns to its initial position, the print head being inked during each cycle, wherein the labels are disposed on a carrier web and are dispensed at a delaminator when the carrier web is advanced by a driver, and blocking the return of the actuator to its initial position when the actuator has been operated a predetermined number of times to prevent further operation of the labeler.

* * * * *

UNITED STATES PATENT AND TRADEMARK OFFICE

CERTIFICATE OF CORRECTION

PATENT NO. : 4,516,498

DATED : May 14, 1985

INVENTOR(S) : John D. Mistyurik

It is certified that error appears in the above-identified patent and that said Letters Patent are hereby corrected as shown below:

Column 10, line 10, "to" should be --of--; line 12, after "steps" --of-- has been omitted.

Signed and Sealed this

*Twenty-fourth* Day of *September 1985*

[SEAL]

*Attest:*

DONALD J. QUIGG

*Attesting Officer*

*Commissioner of Patents and Trademarks—Designate*